US010746020B2

(12) United States Patent
Zhang et al.

(10) Patent No.: US 10,746,020 B2
(45) Date of Patent: Aug. 18, 2020

(54) VERTICAL LIFTING TYPE DRUM COAL-MINING MACHINE WITHOUT ROCKER ARM

(71) Applicant: Yimin Zhang, Shenyang, Liaoning Province (CN)

(72) Inventors: Yimin Zhang, Shenyang (CN); Wenjia Lu, Shenyang (CN); Yanhui Zhao, Shenyang (CN); Jinrui Zhang, Shenyang (CN); Lisha Zhu, Shenyang (CN); Hangyuan Lv, Shenyang (CN); Xuefei Tan, Shenyang (CN); Guo Yao, Shenyang (CN); Zhou Yang, Shenyang (CN)

(73) Assignee: Yimin Zhang, Shenyang, Liaoning Province (CN)

( * ) Notice: Subject to any disclaimer, the term of this patent is extended or adjusted under 35 U.S.C. 154(b) by 85 days.

(21) Appl. No.: 16/311,549

(22) PCT Filed: Aug. 8, 2018

(86) PCT No.: PCT/CN2018/099353
§ 371 (c)(1),
(2) Date: Dec. 19, 2018

(87) PCT Pub. No.: WO2019/029557
PCT Pub. Date: Feb. 14, 2019

(65) Prior Publication Data

US 2020/0011174 A1 Jan. 9, 2020

(30) Foreign Application Priority Data

Aug. 8, 2017 (CN) ..... 2017 1 0685801

(51) Int. Cl.
*E21C 31/02* (2006.01)
*E21C 29/02* (2006.01)
(Continued)

(52) U.S. Cl.
CPC ..... *E21C 27/02* (2013.01); *E21C 25/06* (2013.01); *E21C 29/02* (2013.01); *E21C 31/02* (2013.01);
(Continued)

(58) Field of Classification Search
CPC ..... E21C 27/02; E21C 29/02; E21C 31/08; E21C 31/00; E21C 31/02; E21C 31/10; E21C 31/12
See application file for complete search history.

(56) References Cited

U.S. PATENT DOCUMENTS 4,275,927 A * 6/1981 Merten ..... E21C 27/32 299/34.03
4,508,391 A * 4/1985 Spektor ..... E21C 35/06 299/43
(Continued)

FOREIGN PATENT DOCUMENTS

CN 200946508 Y 9/2007
CN 103670401 A 3/2014
(Continued)

*Primary Examiner* — David J Bagnell
*Assistant Examiner* — Michael A Goodwin
(74) *Attorney, Agent, or Firm* — Muncy, Geissler, Olds & Lowe, P.C.

(57) ABSTRACT

A vertical lifting type drum coal-mining machine without a rocker arm includes a central control box, left and right cutting and lifting reduction gear boxes, left and right guide rail fixing box bodies, left and right traction reduction gear boxes, and left and right traveling gear boxes. The left and right cutting and lifting reduction gear boxes are provided with slideways in fit with lifting guide rails of the left and right guide rail fixing box bodies. Lifting cylinders drive the left and right cutting and lifting reduction gear boxes to make lifting motion. A cutting gear reduction mechanism adopts two-stage fixed-axle gear transmission and two-stage planetary gear transmission, is free from multiple idler
(Continued)

pulley groups and has simple transmission chain. The fit between the lifting guide rails and the slideways enables the entire machine to be compact in structure, and the reliability and stability of operation are improved.

9 Claims, 4 Drawing Sheets

(51) Int. Cl.

| | |
|---|---|
| ***E21C 31/08*** | (2006.01) |
| ***E21C 27/02*** | (2006.01) |
| ***E21C 25/06*** | (2006.01) |
| ***E21C 35/12*** | (2006.01) |
| *E21C 31/10* | (2006.01) |
| *E21C 31/12* | (2006.01) |

(52) U.S. Cl.
CPC ..... *E21C 31/08* (2013.01); *E21C 35/12* (2013.01); *E21C 31/10* (2013.01); *E21C 31/12* (2013.01)

(56) References Cited

U.S. PATENT DOCUMENTS 4,548,444 A * 10/1985 Breuer ..... E21C 31/08 299/34.11
4,776,637 A * 10/1988 Dawson ..... E21C 27/02 299/1.6

FOREIGN PATENT DOCUMENTS

| | | | | |
|---|---|---|---|---|
| CN | 105201500 | A | 12/2015 | |
| CN | 205400724 | U | 7/2016 | |
| CN | 107476804 | A | 12/2017 | |
| DE | 3810374 | C1 | 11/1989 | |
| DE | 19637973 | A1 * | 3/1998 | ..... E21C 31/08 |

* cited by examiner

VERTICAL LIFTING TYPE DRUM COAL-MINING MACHINE WITHOUT ROCKER ARM

BACKGROUND OF THE INVENTION

1. Field of the Invention

The present invention relates generally to a coal-mining machine, and more particularly, to provide a vertical lifting type drum coal-mining machine without a rocker arm.

2. The Prior Arts

The coal-mining machine is main highly-integrated and highly-automated mining equipment for mining medium-thickness coal seams at present. Currently, the coal-mining machine for mining coal in medium-thickness coal seams is drum coal-mining machine with rocker arm both at home and abroad, wherein a double-drum coal-mining machine is most widely applied. Therefore, the rocker arm of the drum coal-mining machine not only is used as a robot arm but also has the function of cutting reduction. In order to achieve the required mining height, multiple idler pulley groups need to be additionally disposed in the cutting reduction transmission process. On the one hand, this structure enables the cutting transmission system to be complex, and the complex transmission chain enables the reliability of the transmission system to be reduced; on the other hand, the rocker arm needs to bear stress concentration caused by multiple groups of bearing hole seats, and also bears tremendous gear engagement acting force, and therefore, the failure of the rocker arm structure is easy to cause.

SUMMARY OF THE INVENTION

A primary objective of the present invention is to provide a vertical lifting type drum coal-mining machine without a rocker arm, which is provided with a more compact cutting transmission system and simpler transmission chain and is higher in reliability.

The vertical lifting type drum coal-mining machine without a rocker arm, provided by the invention, includes a central control box, a left supporting box body, a right supporting box body, a left guide rail fixing box body, a right guide rail fixing box body, a left traveling gear box, and a right traveling gear box; wherein the left supporting box body and the right supporting box body are symmetrically arranged below the central control box, the left guide rail fixing box body and the right guide rail fixing box body are symmetrically arranged on two sides of the central control box, the left supporting box body, the right supporting box body and the central control box are mutually and fixedly connected, the left guide rail fixing box body, the right guide rail fixing box body and the central control box are mutually and fixedly connected, one end of the left traveling gear box is fixed in the left supporting box body, the other end of the left traveling gear box is fixed in the left guide rail fixing box body, one end of the right traveling gear box is fixed in the right supporting box body, and the other end of the right traveling gear box is fixed in the right guide rail fixing box body; and a left cutting and lifting reduction gear box is disposed in the left guide rail fixing box body, a right cutting and lifting reduction gear box is disposed in the right guide rail fixing box body, a left traction reduction gear box is disposed in the left supporting box body, a right traction reduction gear box is disposed in the right supporting box body, an output shaft of the left traction reduction gear box is connected with an input shaft of the left traveling gear box, an output shaft of the right traction reduction gear box is connected with an input shaft of the right traveling gear box, and a traveling output gear of the left traveling gear box and a traveling output gear of the right traveling gear box are both engaged with a pin rail of a scraper conveyor, so that the coal-mining machine makes left-to-right traction motion on the pin rail. The left guide rail fixing box body and the right guide rail fixing box body have the same structure. Lifting guide rails are symmetrically arranged on a left inner wall and a right inner wall of the left guide rail fixing box body, and lifting guide rails are symmetrically arranged on a left inner wall and a right inner wall of the right guide rail fixing box body. Slideways in fit with the lifting guide rails on the left inner wall and the right inner wall of the left guide rail fixing box body and lifting cylinders symmetrical-arranged are disposed on a left outer wall and a right outer wall of the left cutting and lifting reduction gear box. The lifting cylinders drive the left cutting and lifting reduction gear box to make lifting motion along the lifting guide rails on the left inner wall and the right inner wall of the left guide rail fixing box body. Slideways in fit with the lifting guide rails on the left inner wall and the right inner wall of the right guide rail fixing box body and lifting cylinders symmetrical-arranged are disposed on a left outer wall and a right outer wall of the right cutting and lifting reduction gear box. The lifting cylinders drive the right cutting and lifting reduction gear box to make lifting motion along the lifting guide rails on the left inner wall and the right inner wall of the right guide rail fixing box body. The left cutting and lifting reduction gear box and the right cutting and lifting reduction gear box have the same structure, and each of which is provided with a cutting motor, a cutting gear reduction mechanism, and a spiral drum, wherein the spiral drum of the left cutting and lifting reduction gear box is located on an outer side of the left guide rail fixing box body; the spiral drum of the right cutting and lifting reduction gear box is located on an outer side of the right guide rail fixing box body; and the cutting motor drives the spiral drum to rotate through the cutting gear reduction mechanism. The central control box is used for controlling the start, the stop and the left-to-right traction motion of the coal-mining machine as well as the lifting motion of the spiral drums.

Further, a drive shaft of the cutting motor is coaxially connected with an input shaft of the cutting gear reduction mechanism. The cutting gear reduction mechanism also includes a cutting input gear coaxially connected with the input shaft, a first cutting gear engaged with the cutting input gear, a second cutting pinion engaged with the first cutting gear, a second cutting bull gear coaxial with the second cutting pinion, a third cutting gear engaged with the second cutting bull gear, a first cutting planetary gear set coaxially connected with the third cutting gear through a connecting disc, a second cutting planetary gear set coaxially connected with the first cutting planetary gear set, a first cutting output gear coaxially connected with the second cutting planetary gear set, and a second cutting output gear engaged with the first cutting output gear. An output shaft of the second cutting output gear is connected with the spiral drum.

Further, the first cutting planetary gear set includes a first cutting sun gear coaxially connected with the third cutting gear and a first cutting planetary gear engaged with the first cutting sun gear, wherein the first cutting planetary gear is engaged with a first cutting inner gear ring, and the first cutting planetary gear is disposed on a first cutting planetary carrier through a first cutting planetary shaft; and the second cutting planetary gear set includes a second cutting sun gear coaxially connected with the first cutting planetary carrier and a second cutting planetary gear engaged with the second cutting sun gear, wherein the second cutting planetary gear is engaged with a second cutting inner gear ring, the second cutting planetary gear is disposed on a second cutting planetary carrier through a second cutting planetary shaft, and the second cutting planetary carrier is coaxially connected with the first cutting output gear.

Further, the central control box and the left supporting box body, the central control box and the right supporting box body, the left supporting box body and the right supporting box body, the central control box and the left guide rail fixing box body as well as the central control box and the right guide rail fixing box body are all connected through threaded studs, gaskets and nuts. The left guide rail fixing box body and the right guide rail fixing box body are connected through long pull rods, gaskets and hydraulic nuts.

Further, the left traction reduction gear box and the right traction reduction gear box have the same structure, and each of which is provided with a traction motor and a traction gear transmission mechanism, wherein a drive shaft of the traction motor is connected with an input shaft of the traction gear transmission mechanism. The traction gear transmission mechanism also includes a traction input gear coaxially connected with the input shaft, a first traction bull gear engaged with the traction input gear, a first traction pinion coaxial with the first traction bull gear, a second traction gear engaged with the first traction pinion, a first traction planetary gear set coaxially connected with the second traction gear, and a second traction planetary gear set coaxially connected with the first traction planetary gear set. An output shaft of the second traction planetary gear set in the left traction reduction gear box is connected with an input shaft of the left traveling gear box. An output shaft of a second traction planetary gear set in the right traction reduction gear box is connected with an input shaft of the right traveling gear box.

Further, the left traveling gear box and the right traveling gear box have the same structure, and each of which is provided with a traveling input gear, a first traveling gear engaged with the traveling input gear, a second traveling gear engaged with the first traveling gear, and a third traveling gear engaged with the second traveling gear, wherein the traveling input gear of the left traveling gear box is coaxially connected with the input shaft of the left traveling gear box, the third traveling gear of the left traveling gear box is engaged with the traveling output gear of the left traveling gear box, the traveling input gear of the right traveling gear box is coaxially connected with the input shaft of the right traveling gear box, and the third traveling gear of the right traveling gear box is engaged with the traveling output gear of the right traveling gear box.

Further, two pairs of lifting guide rails are symmetrically arranged on left inner walls and right inner walls of the left guide rail fixing box body and the right guide rail fixing box body respectively, the two pairs of lifting guide rails on the left inner wall and the right inner wall of the left guide rail fixing box body are respectively disposed to correspond to a front end and a rear end of the left cutting and lifting reduction gear box, and the two pairs of lifting guide rails on the left inner wall and the right inner wall of the right guide rail fixing box body are respectively disposed to correspond to a front end and a rear end of the right cutting and lifting reduction gear box. Sliding cushion blocks are disposed on outer surfaces of the slideways at upper and lower ends of the slideways on the left cutting and lifting reduction gear box and the right cutting and lifting reduction gear box in fit with the corresponding two pairs of lifting guide rails, so that a gap exists between the left cutting and lifting reduction gear box and the left guide rail fixing box body in a front-and-rear direction and a gap exists between the right cutting and lifting reduction gear box and the right guide rail fixing box body in the front-and-rear direction.

Further, two sides of the lifting guide rails on the left inner walls and the right inner walls of the left and right guide rail fixing box bodies are fixed through angle steel with supporting rib plates.

Two sides of the lifting guide rails on the left inner walls and the right inner walls of the left and right guide rail fixing box bodies are fixed through angle steel with supporting rib plates.

Compared with the prior art, the vertical lifting type drum coal-mining machine disclosed by the present invention has the following advantages:

1. the lifting guide rails disposed in the left guide rail fixing box body and the right guide rail fixing box body are adapted to cooperate with slideways on the left cutting and lifting reduction gear box and the right cutting and lifting reduction gear box to replace the rocker arm structure easy to fail and break in the prior art, so that the left cutting and lifting reduction gear box and the right cutting and lifting reduction gear box make lifting motion to further drive the spiral drum to work. The lifting guide rails are in close fit with the slideways, so that the mechanical vibration made by the spiral drum for mining in the lifting process is also reduced, and the unit works more steadily;

2. the central control box, the left supporting box body, the right supporting box body, the left guide rail fixing box body and the right guide rail fixing box body are mechanically connected, and tightly and integrally fixed, and the tremendous mining force produced by the spiral drum is borne by the integrated machine, so that the impact failure of the lifting guide rails by the mining load is reduced to a greater extent, and besides, the impact vibration caused by mining force is reduced;

3. two sides of the lifting guide rails on the left inner walls and the right inner walls of the left and right guide rail fixing box bodies are fixed through angle steel with supporting rib plates, so that the structure of the lifting guide rails is more stable, and the bearing capability is further enhanced; sliding cushion blocks are disposed at the outer surfaces of the slideways at the upper and lower ends of the slideways on the left cutting and lifting reduction gear box and the right cutting and lifting reduction box in fit with the lifting guide rails, so that a gap exists between the left cutting and lifting reduction box and the left guide rail fixing box body in a front-and-rear direction and a gap exists between the right cutting and lifting reduction box and the right guide rail fixing box body in the front-and-rear direction, direct contact is avoided, friction in the lifting process is reduced, and the lifting motion becomes more smooth and steady; and 4. the cutting gear reduction mechanism in the cutting and lifting reduction box adopts two-stage fixed-axle gear transmission and two-stage planetary gear transmission to realize cutting reduction and is free from multiple idler pulley group mechanisms, so the structure arrangement is compact, the transmission chain is simpler, and reliability and stability of mechanical transmission are improved.

DETAILED DESCRIPTION OF THE PREFERRED EMBODIMENT

The embodiments of the present invention will be further described with reference to the appended drawings and the embodiments. The following embodiments are only used to depict the present invention without limiting the scope of the present invention.

Figure 1:
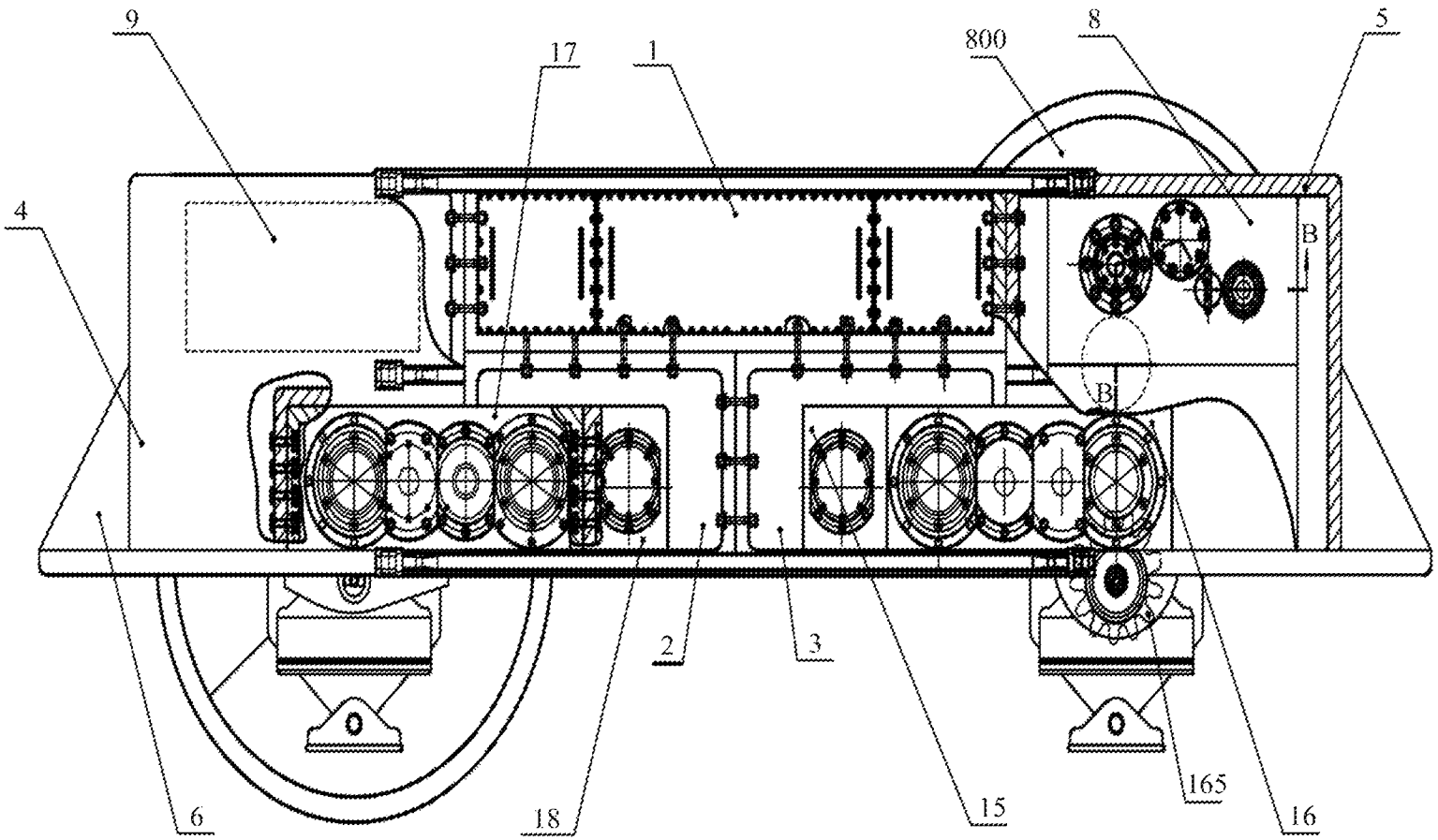
FIG. 1 is a front schematic view of the vertical lifting type drum coal-mining machine without a rocker arm provided by the embodiment of the present invention.
Figure 2:
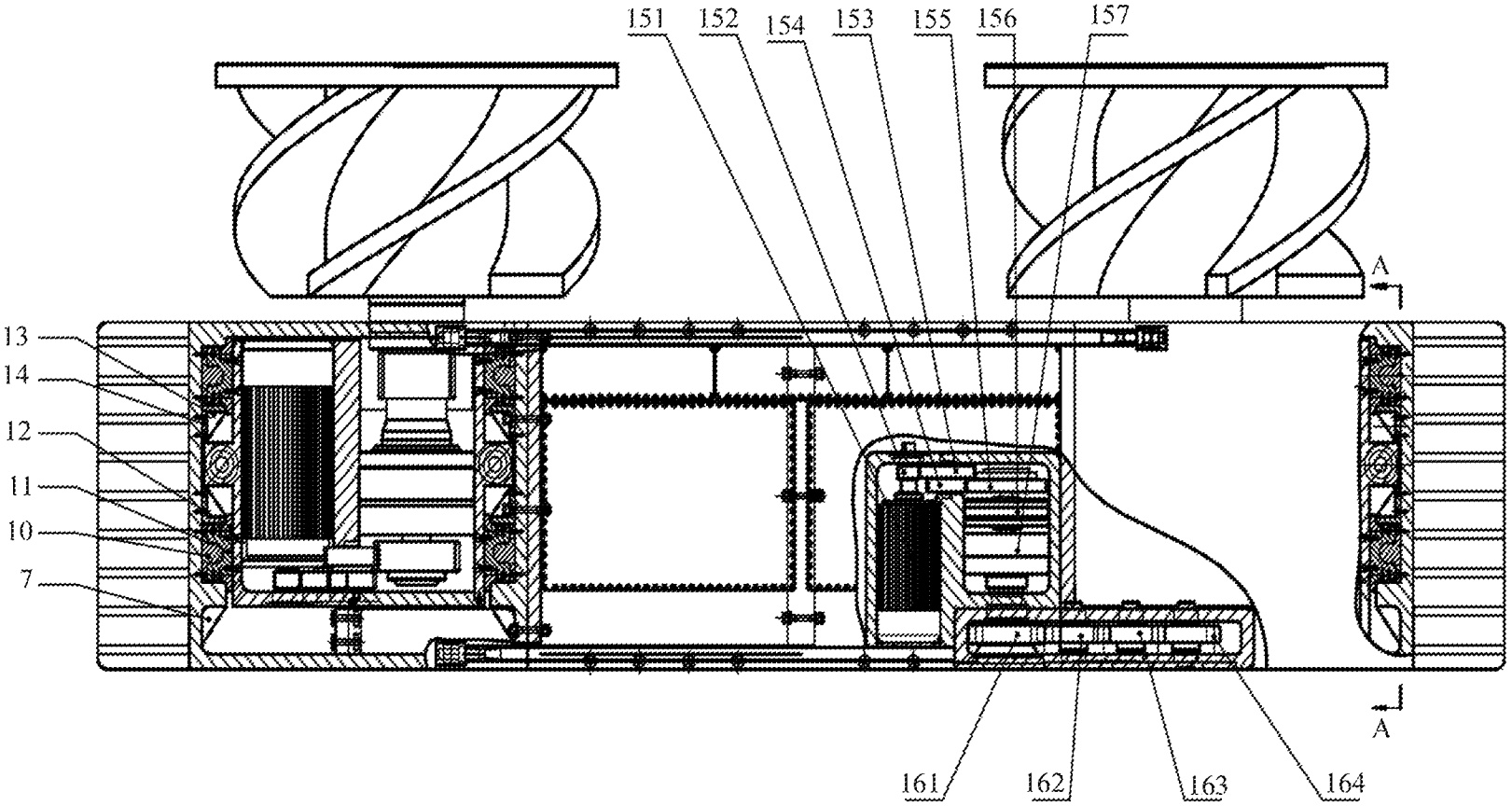
FIG. 2 is a top schematic view of the vertical lifting type drum coal-mining machine without a rocker arm provided by the embodiment of the present invention.

As shown in FIG. 1 and FIG. 2, the vertical lifting type drum coal-mining machine without a rocker arm provided by the present invention is applicable to mining of medium-thickness long-wall coal seams with dip angle less than 30 degrees and medium hard and hard coal quality. The vertical lifting type drum coal-mining machine without a rocker arm includes a central control box 1, a left supporting box body 2, a right supporting box body 3, a left guide rail fixing box body 4, a right guide rail fixing box body 5, a left traveling gear box 17, and a right traveling gear box 16, wherein the left supporting box body 2 and the right supporting box body 3 are symmetrically arranged below the central control box 1, the left guide rail fixing box body 4 and the right guide rail fixing box body 5 are symmetrically arranged on two sides of the central control box 1, and an outer surface of the central control box 1, an outer surface of the left supporting box body 2, an outer surface of the right supporting box body 3, an outer surface of the left guide rail fixing box body 4 and an outer surface of the right guide rail fixing box body 5 are fixedly connected. The central control box 1 and the left supporting box body 2, the central control box 1 and the right supporting box body 3, the left supporting box body 2 and the right supporting box body 3, the central control box 1 and the left guide rail fixing box body 4, as well as the central control box 1 and the right guide rail fixing box body 5 are all connected through threaded studs, gaskets and hydraulic nuts. The left guide rail fixing box body 4 and the right guide rail fixing box body 5 are connected through long pull rods, gaskets and hydraulic nuts. One end of the left traveling gear box 17 is fixed in the left supporting box body 2, the other end of the left traveling gear box 17 is fixed in the left guide rail fixing box body 4, one end of the right traveling gear box 16 is fixed in the right supporting box body 3, and the other end of the right traveling gear box 16 is fixed in the right guide rail fixing box body 5. Fixing box outer rib plates 6 and fixing box inner rib plates 7 are respectively disposed inside and outside the left guide rail fixing box body 4 and the right guide rail fixing box body 5.

Figure 3:
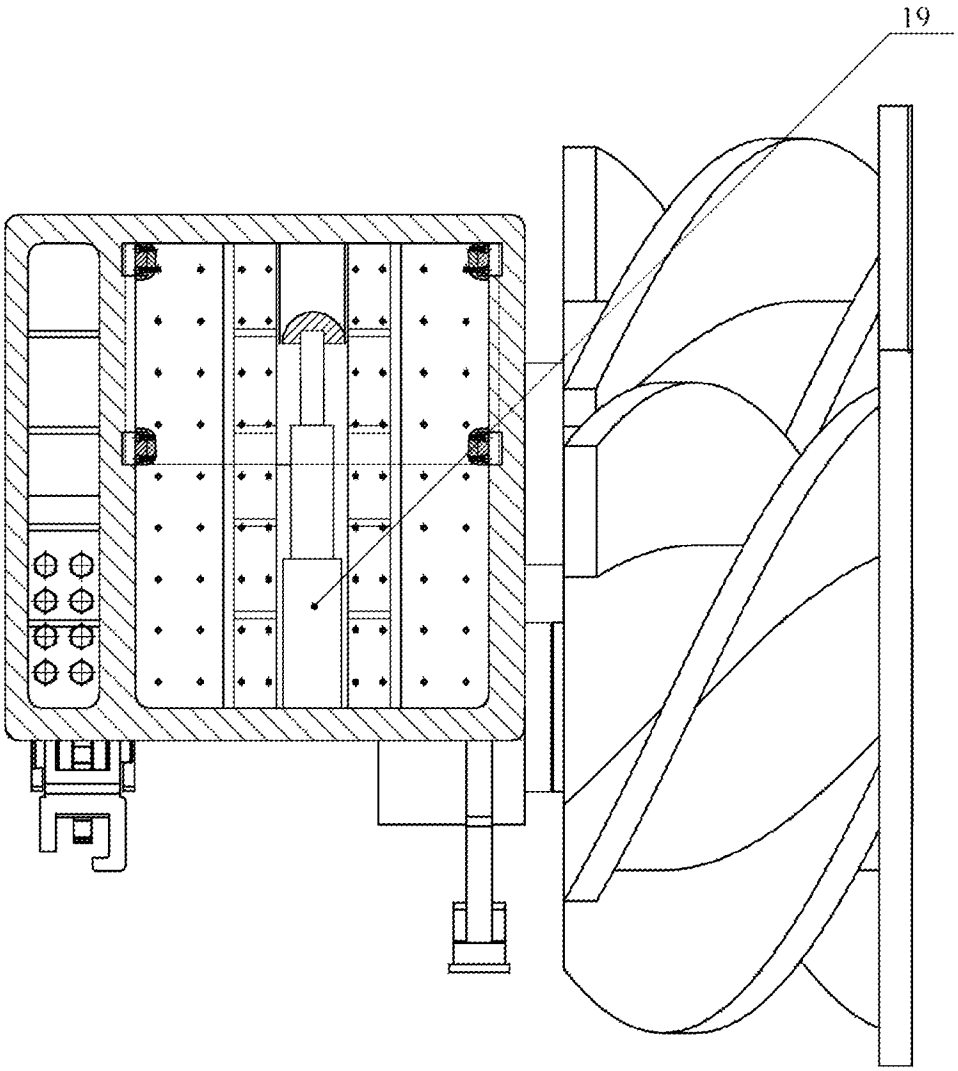
FIG. 3 is a cross-sectional view taken along line A-A of FIG. 2.

As shown in FIG. 1, FIG. 2 and FIG. 3, a left cutting and lifting reduction gear box 9 is disposed in the left guide rail fixing box body 4, a right cutting and lifting reduction gear box 8 is disposed in the right guide rail fixing box body 5, a left traction reduction gear box 18 is disposed in the left supporting box body 2, a right traction reduction gear box 15 is disposed in the right supporting box body 3, an output shaft of the left traction reduction gear box 18 is connected with an input shaft of the left traveling gear box 17, an output shaft of the right traction reduction gear box 15 is connected with an input shaft of the right traveling gear box 16, and a traveling output gear of the left traveling gear box 17 and a traveling output gear 165 of the right traveling gear box 16 are both engaged with a pin rail of a scraper conveyor, so that the coal-mining machine makes left-to-right traction motion on the pin rail.

The left guide rail fixing box body 4 and the right guide rail fixing box body 5 have the same structure. Two pairs of lifting guide rails 10 are symmetrically arranged on a left inner wall and a right inner wall of the left guide rail fixing box body 4, and two sides of the lifting guide rails 10 on the left inner wall and the right inner wall of the left guide rail fixing box body 4 are fixed through angle steel 14 with supporting rib plates 13. The two pairs of lifting guide rails 10 on the left inner wall and the right inner wall of the left guide rail fixing box body 4 are respectively disposed to correspond to a front end and a rear end of the left cutting and lifting reduction gear box 9. Slideways 11 in fit with the two pairs of lifting guide rails 10 on the left inner wall and the right inner wall of the left guide rail fixing box body 4 and lifting cylinders symmetrical-arranged are disposed on a left outer wall and a right outer wall of the left cutting and lifting reduction gear box 9. The lifting cylinders drive the left cutting and lifting reduction gear box 9 to make lifting motion along the lifting guide rails 10 on the left inner wall and the right inner wall of the left guide rail fixing box body 4. Further, sliding cushion blocks 12 are disposed on outer surfaces of the slideways 11 at an upper end and an lower end of the slideways 11 on the left cutting and lifting reduction gear box 9 in fit with the corresponding two pairs of lifting guide rails 10, so that a gap exists between the left cutting and lifting reduction gear box 9 and the left guide rail fixing box body 4 in a front-and-rear direction, and the distance is between 10 mm and 15 mm. Similarly, two pairs of lifting guide rails are also symmetrically arranged on a left inner wall and a right inner wall of the right guide rail fixing box body 5 and are respectively disposed to correspond to a front end and a rear end of the right cutting and lifting reduction gear box 8. Slideways in fit with the two pairs of lifting guide rails on the left inner wall and the right inner wall of the right guide rail fixing box body 5 and lifting cylinders 19 symmetrical-arranged are disposed on a left outer wall and a right outer wall of the right cutting and lifting reduction gear box 8. The lifting cylinders 19 drive the right cutting and lifting reduction gear box 8 to make lifting motion along the lifting guide rails on the left inner wall and the right inner wall of the right guide rail fixing box body 5. Furthermore, sliding cushion blocks are disposed on outer surfaces of the slideways at an upper end and an lower end of the slideways on the right cutting and lifting reduction gear box 8 in fit with the corresponding two pairs of lifting guide rails, so that a gap exists between the right cutting and lifting reduction gear box 8 and the right guide rail fixing box body 5 in the front-and-rear direction, and the distance is between 10 mm and 15 mm.

Figure 4:
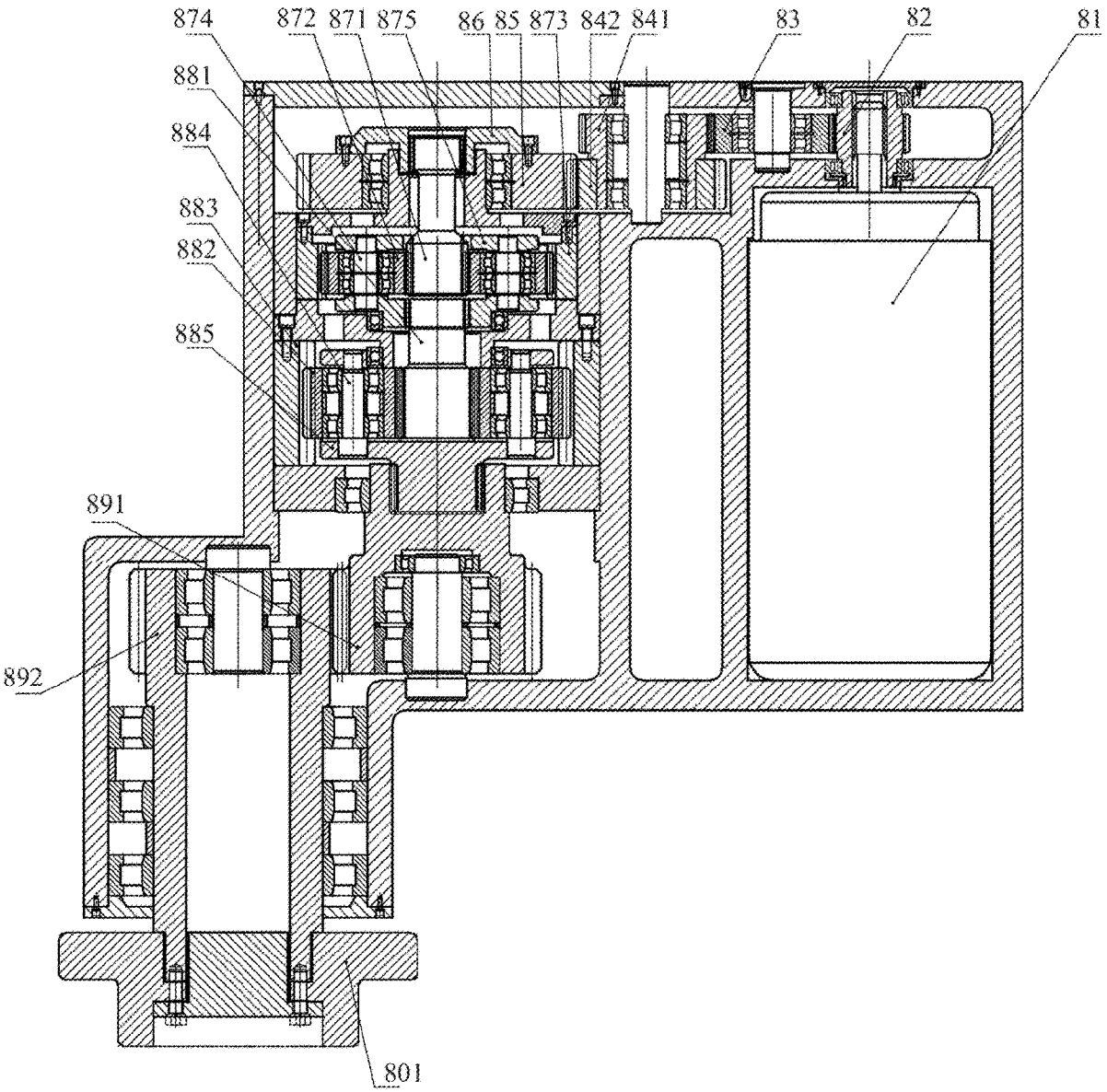
FIG. 4 is a cross-sectional view taken along line B-B of FIG. 1.

As shown in FIG. 1, FIG. 2 and FIG. 4, the left cutting and lifting reduction gear box 9 and the right cutting and lifting reduction gear box 8 have the same structure, and the right cutting and lifting reduction gear box 8 will be described in detail. The right cutting and lifting reduction gear box 8 is provided with a cutting motor 81, a cutting gear reduction mechanism, and a spiral drum 800, wherein the spiral drum 800 is located on an outer side of the right guide rail fixing box body 5 and is used for cutting a coal seam, and the cutting motor 81 drives the spiral drum 800 to rotate through the cutting gear reduction mechanism. Similarly, a spiral drum of the left cutting and lifting reduction gear box 9 is located on an outer side of the left guide rail fixing box body 4. Specifically, a drive shaft of the cutting motor 81 is coaxially connected with an input shaft of the cutting gear reduction mechanism. The cutting gear reduction mechanism also includes a cutting input gear 82 coaxially connected with the input shaft, a first cutting gear 83 engaged with the cutting input gear 82, a second cutting pinion 841 engaged with the first cutting gear 83, a second cutting bull gear 842 coaxial with the second cutting pinion 841, a third cutting gear 85 engaged with the second cutting bull gear 842, a first cutting planetary gear set coaxially connected with the third cutting gear 85 through a connecting disc 86, a second cutting planetary gear set coaxially connected with the first cutting planetary gear set, a first cutting output gear 891 coaxially connected with the second cutting planetary gear set, and a second cutting output gear 892 engaged with the first cutting output gear 891. An output shaft of the second cutting output gear 892 is connected with the spiral drum 800 through a connecting head 801.

Further, the first cutting planetary gear set includes a first cutting sun gear 871 coaxially connected with the third cutting gear 85 and a first cutting planetary gear 872 engaged with the first cutting sun gear 871, wherein the first cutting planetary gear 872 is engaged with a first cutting inner gear ring 873, and the first cutting planetary gear 872 is disposed on a first cutting planetary carrier 875 through a first cutting planetary shaft 874; and the second cutting planetary gear set includes a second cutting sun gear 881 coaxially connected with the first cutting planetary carrier 875 and a second cutting planetary gear 882 engaged with the second cutting sun gear 881, wherein the second cutting planetary gear 882 is engaged with a second cutting inner gear ring 883, the second cutting planetary gear 882 is disposed on a second cutting planetary carrier 885 through a second cutting planetary shaft 884, and the second cutting planetary carrier 885 is coaxially connected with the first cutting output gear 891.

As shown in FIG. 1 and FIG. 2, the left traction reduction gear box 18 and the right traction reduction gear box 15 have the same structure, and the right traction reduction gear box 15 will be described in detail. The right traction reduction gear box 15 is provided with a traction motor 151 and a traction gear transmission mechanism, wherein a drive shaft of the traction motor 151 is connected with an input shaft of the traction gear transmission mechanism. The traction gear transmission mechanism also includes a traction input gear 152 coaxially connected with the input shaft, a first traction bull gear 153 engaged with the traction input gear 152, a first traction pinion 154 coaxial with the first traction bull gear 153, a second traction gear 155 engaged with the first traction pinion 154, a first traction planetary gear set 156 coaxially connected with the second traction gear 155, and a second traction planetary gear set 157 coaxially connected with the first traction planetary gear set 156. An output shaft of the second traction planetary gear set 157 is connected with an input shaft of the right traveling gear box 16. Similarly, an output shaft of a second traction planetary gear set in the left traction reduction gear box 18 is connected with an input shaft of the left traveling gear box 17.

The left traveling gear box 17 and the right traveling gear box 16 have the same structure, and the right traveling gear box 16 will be described in detail. The right traveling gear box 16 is provided with a traveling input gear 161, a first traveling gear 162 engaged with the traveling input gear 161, a second traveling gear 163 engaged with the first traveling gear 162, and a third traveling gear 164 engaged with the second traveling gear 163, wherein the third traveling gear 164 is engaged with the traveling output gear 165 of the right traveling gear box 16, and the traveling input gear 161 is coaxially connected with the input shaft of the right traveling gear box 16. Similarly, the traveling input gear of the left traveling gear box 17 is coaxially connected with the input shaft of the left traveling gear box 17, and the third traveling gear of the left traveling gear box 17 is engaged with the traveling output gear of the left traveling gear box 17. The central control box 1 is used for controlling the start, the stop and the left-to-right traction motion of the coal-mining machine as well as the lifting motion of the spiral drums.

Finally, it should be noted that the above embodiments are only used for depicting the technical scheme of the present invention rather than limiting the present invention. Although the present invention is described in detail with reference to the previous embodiments, those of ordinary skilled in the art should understand that: they can still modify the technical scheme recorded in the previous embodiment or make equivalent substitutions of part or all technical features therein; and these modifications or substitutions do not make the nature of the corresponding technical scheme deviate from the scope limited by the claims of the present invention.

What is claimed is:

1. A vertical lifting type drum coal-mining machine without a rocker arm, comprising: a central control box, a left supporting box body, a right supporting box body, a left guide rail fixing box body, a right guide rail fixing box body, a left traveling gear box, and a right traveling gear box;

wherein the left supporting box body and the right supporting box body are symmetrically arranged below the central control box, the left guide rail fixing box body and the right guide rail fixing box body are symmetrically arranged on two sides of the central control box, the left supporting box body, the right supporting box body and the central control box are mutually and fixedly connected, the left guide rail fixing box body, the right guide rail fixing box body and the central control box are mutually and fixedly connected, one end of the left traveling gear box is fixed in the left supporting box body, the other end of the left traveling gear box is fixed in the left guide rail fixing box body, one end of the right traveling gear box is fixed in the right supporting box body, and the other end of the right traveling gear box is fixed in the right guide rail fixing box body;

a left cutting and lifting reduction gear box is disposed in the left guide rail fixing box body, a right cutting and lifting reduction gear box is disposed in the right guide rail fixing box body, a left traction reduction gear box is disposed in the left supporting box body, a right traction reduction gear box is disposed in the right supporting box body, an output shaft of the left traction reduction gear box is connected with an input shaft of the left traveling gear box, an output shaft of the right traction reduction gear box is connected with an input shaft of the right traveling gear box, and the coal-mining machine makes left-to-right traction motion;

the left guide rail fixing box body and the right guide rail fixing box body have the same structure; lifting guide rails are symmetrically arranged on a left inner wall and a right inner wall of the left guide rail fixing box body, and lifting guide rails are symmetrically arranged on a left inner wall and a right inner wall of the right guide rail fixing box body; slideways in fit with the lifting guide rails on the left inner wall and the right inner wall of the left guide rail fixing box body and lifting cylinders symmetrical-arranged are disposed on a left outer wall and a right outer wall of the left cutting and lifting reduction gear box; the lifting cylinders drive the left cutting and lifting reduction gear box to make lifting motion along the lifting guide rails on the left inner wall and the right inner wall of the left guide rail fixing box body; slideways in fit with the lifting guide rails on the left inner wall and the right inner wall of the right guide rail fixing box body and lifting cylinders symmetrical-arranged are disposed on a left outer wall and a right outer wall of the right cutting and lifting reduction gear box; the lifting cylinders drive the right cutting and lifting reduction gear box to make lifting motion along the lifting guide rails on the left inner wall and the right inner wall of the right guide rail fixing box body;

the left cutting and lifting reduction gear box and the right cutting and lifting reduction gear box have the same structure, and each of which is provided with a cutting motor, a cutting gear reduction mechanism, and a spiral drum, wherein the spiral drum of the left cutting and lifting reduction gear box is located on an outer side of the left guide rail fixing box body; the spiral drum of the right cutting and lifting reduction gear box is located on an outer side of the right guide rail fixing box body; and the cutting motor drives the spiral drum to rotate through the cutting gear reduction mechanism; and the central control box is used for controlling the start, the stop and the left-to-right traction motion of the coal-mining machine as well as the lifting motion of the spiral drums.

2. The vertical lifting type drum coal-mining machine without a rocker arm according to claim 1, wherein a drive shaft of the cutting motor is coaxially connected with an input shaft of the cutting gear reduction mechanism; the cutting gear reduction mechanism also includes a cutting input gear coaxially connected with the input shaft, a first cutting gear engaged with the cutting input gear, a second cutting pinion engaged with the first cutting gear, a second cutting bull gear coaxial with the second cutting pinion, a third cutting gear engaged with the second cutting bull gear, a first cutting planetary gear set coaxially connected with the third cutting gear through a connecting disc, a second cutting planetary gear set coaxially connected with the first cutting planetary gear set, a first cutting output gear coaxially connected with the second cutting planetary gear set, and a second cutting output gear engaged with the first cutting output gear; and wherein an output shaft of the second cutting output gear is connected with the spiral drum.

3. The vertical lifting type drum coal-mining machine without a rocker arm according to claim 2, wherein the first cutting planetary gear set includes a first cutting sun gear coaxially connected with the third cutting gear and a first cutting planetary gear engaged with the first cutting sun gear, wherein the first cutting planetary gear is engaged with a first cutting inner gear ring, and the first cutting planetary gear is disposed on a first cutting planetary carrier through a first cutting planetary shaft; and the second cutting planetary gear set includes a second cutting sun gear coaxially connected with the first cutting planetary carrier and a second cutting planetary gear engaged with the second cutting sun gear, wherein the second cutting planetary gear is engaged with a second cutting inner gear ring, the second cutting planetary gear is disposed on a second cutting planetary carrier through a second cutting planetary shaft, and the second cutting planetary carrier is coaxially connected with the first cutting output gear.

4. The vertical lifting type drum coal-mining machine without a rocker arm according to claim 1, wherein the central control box and the left supporting box body, the central control box and the right supporting box body, the left supporting box body and the right supporting box body, the central control box and the left guide rail fixing box body as well as the central control box and the right guide rail fixing box body are all connected through threaded studs, gaskets and nuts; and the left guide rail fixing box body and the right guide rail fixing box body are connected through long pull rods, gaskets and hydraulic nuts.

5. The vertical lifting type drum coal-mining machine without a rocker arm according to claim 1, wherein the left traction reduction gear box and the right traction reduction gear box have the same structure, and each of which is provided with a traction motor and a traction gear transmission mechanism, wherein a drive shaft of the traction motor is connected with an input shaft of the traction gear transmission mechanism; and wherein the traction gear transmission mechanism also includes a traction input gear coaxially connected with the input shaft, a first traction bull gear engaged with the traction input gear, a first traction pinion coaxial with the first traction bull gear, a second traction gear engaged with the first traction pinion, a first traction planetary gear set coaxially connected with the second traction gear, and a second traction planetary gear set coaxially connected with the first traction planetary gear set; and wherein an output shaft of the second traction planetary gear set in the left traction reduction gear box is connected with an input shaft of the left traveling gear box, and an output shaft of a second traction planetary gear set in the right traction reduction gear box is connected with an input shaft of the right traveling gear box.

6. The vertical lifting type drum coal-mining machine without a rocker arm according to claim 5, wherein the left traveling gear box and the right traveling gear box have the same structure, and each of which is provided with a traveling input gear, a first traveling gear engaged with the traveling input gear, a second traveling gear engaged with the first traveling gear, and a third traveling gear engaged with the second traveling gear, wherein the traveling input gear of the left traveling gear box is coaxially connected with the input shaft of the left traveling gear box, the third traveling gear of the left traveling gear box is engaged with a traveling output gear of the left traveling gear box, the traveling input gear of the right traveling gear box is coaxially connected with the input shaft of the right traveling gear box, and the third traveling gear of the right traveling gear box is engaged with a traveling output gear of the right traveling gear box.

7. The vertical lifting type drum coal-mining machine without a rocker arm according to claim 1, wherein two pairs of lifting guide rails are symmetrically arranged on left inner walls and right inner walls of the left guide rail fixing box body and the right guide rail fixing box body respectively, the two pairs of lifting guide rails on the left inner wall and the right inner wall of the left guide rail fixing box body are respectively disposed to correspond to a front end and a rear end of the left cutting and lifting reduction gear box, and the two pairs of lifting guide rails on the left inner wall and the right inner wall of the right guide rail fixing box body are respectively disposed to correspond to a front end and a rear end of the right cutting and lifting reduction gear box; sliding cushion blocks are disposed at outer surfaces of the slideways at upper and lower ends of the slideways on the left and right cutting and lifting reduction gear boxes in fit with the corresponding two pairs of lifting guide rails, so that a gap exists between the left cutting and lifting reduction gear box and the left guide rail fixing box body in a front-and-rear direction, and a gap exists between the right cutting and lifting reduction gear box and the right guide rail fixing box body in the front-and-rear direction.

8. The vertical lifting type drum coal-mining machine without a rocker arm according to claim 1, wherein two sides of the lifting guide rails on the left inner walls and the right inner walls of the left and right guide rail fixing box bodies are fixed through angle steel with supporting rib plates.

9. The vertical lifting type drum coal-mining machine without a rocker arm according to claim 1, wherein two sides of the lifting guide rails on the left inner walls and the right inner walls of the left and right guide rail fixing box bodies are fixed through angle steel with supporting rib plates.

* * * * *